United States Patent [19]

Huertgen

[11] Patent Number: 4,570,473

[45] Date of Patent: Feb. 18, 1986

[54] EXTRUSION PRESS

[75] Inventor: Helmut B. Huertgen, Pittsburgh, Pa.

[73] Assignee: Sutton Engineering Company, Pittsburgh, Pa.

[21] Appl. No.: 583,053

[22] Filed: Feb. 23, 1984

[51] Int. Cl.[4] ..... B21C 35/04

[52] U.S. Cl. ..... 72/255; 72/273.5

[58] Field of Search ..... 72/255, 256, 257, 273.5

[56] References Cited

U.S. PATENT DOCUMENTS 3,530,702 8/1967 De Ridder ..... 72/255

3,563,079 11/1968 Monie et al. ..... 72/255

4,379,398 4/1983 Asari et al. ..... 72/255

FOREIGN PATENT DOCUMENTS 2094690 9/1982 United Kingdom ..... 72/255

*Primary Examiner*—Lowell A. Larson

*Attorney, Agent, or Firm*—Carothers & Carothers

[57] ABSTRACT

An extrusion press including butt shearing means and cooperating die receiving and holding means carried by the crosshead which supports the free end of the main ram.

20 Claims, 10 Drawing Figures

EXTRUSION PRESS

BACKGROUND OF THE INVENTION

In the metal extrusion arts, it is well known to provide extrusion presses for the indirect extrusion of a metal billet through an extrusion die by the process of holding the axially-elongated billet within a billet container by means of a dummy block or closing plate. A powerful ram is employed to force the contained billet, together with the container, in the axial direction over an elongated hollow stem which carries an extrusion die at the free end thereof. The die thus passes axially into and through the container within which the metallic billet resides to extrude the billet through the die, thereby producing an extruded form. Such indirect extrusion operations result in the formation of a butt or waste portion of the billet at the end of the container adjacent to the closing plate, as it is not possible to extrude all of the billet through the die. The prior art has provided various ways and means for removing the butt end of the billet as is required to free the extruded form from the die and to permit repetitive use of the die. For example, U.S. Pat. No. 3,530,702 discloses an indirect extrusion press including a cutoff saw which is utilized to separate a major extent of the extruded form from a stud end portion thereof whereby the extrusion is separated from the butt end of the billet. U.S. Pat. No. 3,563,079 discloses an indirect extrusion press having a cutoff shear mounted on the forward platen thereof for shearing the billet butt end off of the die.

Other prior art approaches to butt end removal and die handling have included a cutoff shear carried on a longitudinally-movable carrier to move along the ways which also guide and support the main ram crosshead and the container housing, or a shear mounted on the container housing itself.

The prior art has been subject to certain shortcomings. For example, in those extrusion presses having a cutoff shear fixedly mounted adjacent to the platen, the stem which carries the extrusion die must be axially movable with respect to the platen through a considerable range of motion as in the cited U.S. Pat. No. 3,563,079. Such a movable stem is not necessary per se to indirect extrusion operations, but is provided only as an accommodation for the location of the cutoff shear. Accordingly, the press is more complicated in design and operation than it need be. Additionally, it will be noted that to utilize a shear mounted on the forward platen, the die and butt end of the billet must be forced back through the container at the conclusion of each extrusion operation requiring also a large shifting force. This results in considerable unnecessary wear on the interior walls of the container, as well as the possibility of metal coating tear up on the container walls, causing remaining metal particles to form blisters on subsequent extrusions. Also, to prevent the butt from tearing off the die face eliminating the possibility for the butt to become lodged in the container and especially when employing a loose die, the die and butt should be forced back through the container by means of a long stem, resulting in an unnecessary long press design and longer operating times. In those prior extrusion machines wherein a cutoff shear is mounted on the container housing, the reaction surface for the shear is the lower portion of the container interior periphery. Accordingly, large shear stresses are imposed on the container and container housing during butt shearing and the imposition of such forces may result in undue wear on the interior of the container and container housing, also causing misalignment of the container housing or carrier. To prevent shear force action on the container bore, other prior art introduced a cumbersome device supporting the die while shearing (outside the container) thereby transferring the shear load to the container housing.

Other prior art configurations, including the mounting of the cutoff shear on a separate carrier structure moving axially between the forward platen and the container require an un-necessarily long hollow die stem and are also unduly complex and therefore may adversely affect the tooling, duration operating efficiency and machine and tool cost.

SUMMARY OF THE INVENTION

The present invention contemplates an improved indirect extrusion press wherein a cutoff shear is mounted on the main ram crosshead for axial movement therewith. The present invention additionally contemplates a cross slide structure mounted on the front of the main ram crosshead and selectively moveable to position a closing plate or dummy block in line with the billet to close the back end of the container. In its alternate operating position, the cross slide positions a die receiver and clamp to receive the die and butt end when they are ejected from the container and to hold the die in position while the cutoff shear shears off the butt end from the die.

It is therefore one object of the invention to provide an indirect extrusion press having a cutoff shear carried by the main ram crosshead.

An additional object of the present invention is to provide such an improved indirect extrusion press including means carried by the main ram crosshead for selectively positioning a closing plate or a die receiver in operating position wherein the die receiver cooperates with the cutoff shear for butt shearing operations.

Other objects and advantages appear in the following description and claims.

The accompanying drawings show, for the purpose of exemplification without limiting the invention or the claims thereto, certain practical embodiments illustrating the principles of this invention wherein:

Figure 1:
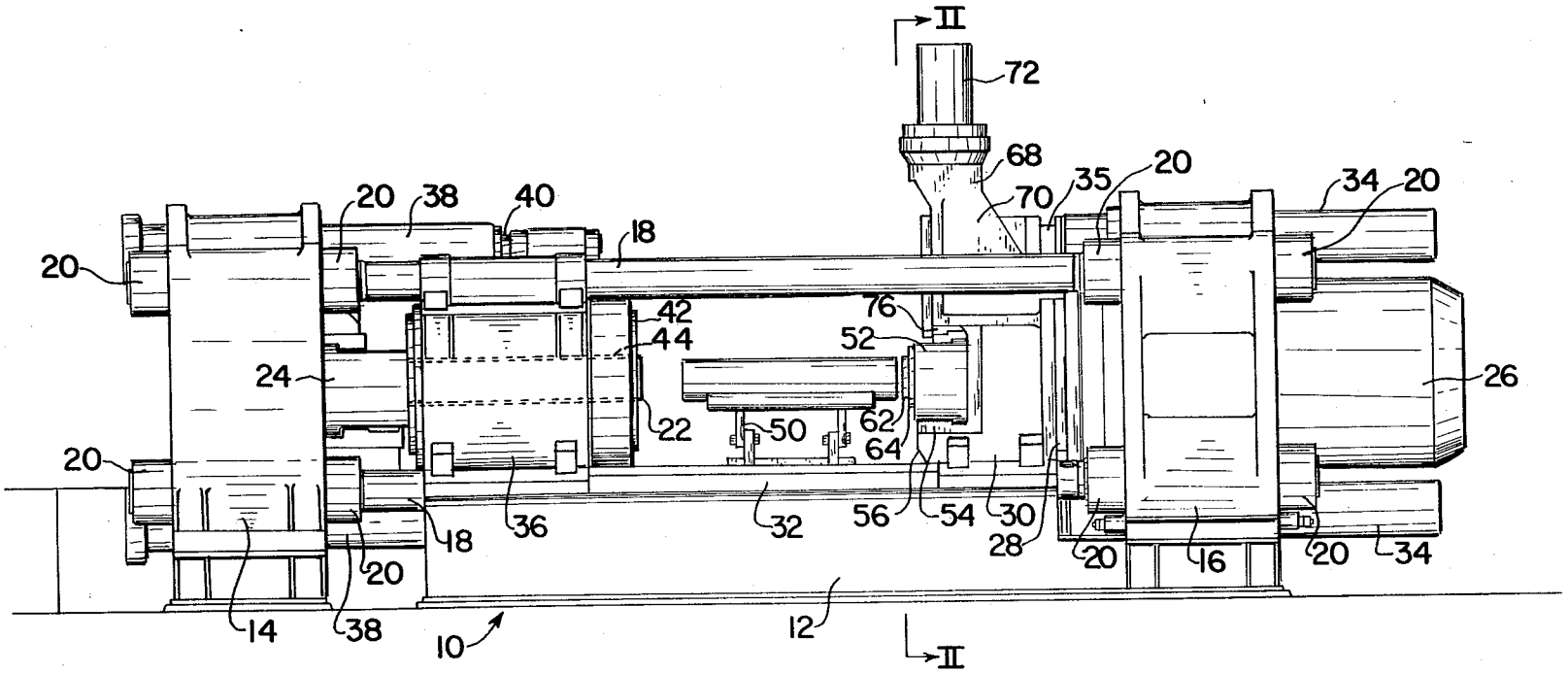
FIG. 1 is a side elevation of an extrusion press according to a presentlypreferred embodiment of the present invention.
Figure 2:
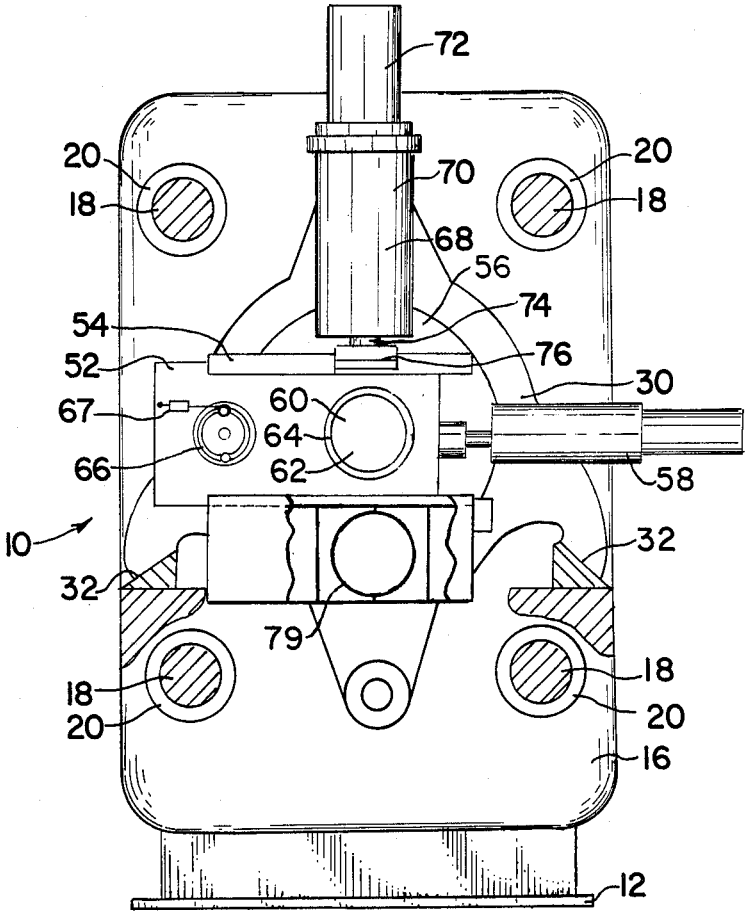
FIG. 2 is a section taken on line 2—2 of FIG. 1.

FIGS. 3 through 10 inclusive are schematic, top plan views which illustrate an operating cycle of the extrusion press of FIGS. 1 and 2.

There is generally indicated at 10 in FIGS. 1 and 2 an extrusion press constructed according to the principles of the present invention. Press 10 includes an elongated main frame 12 on which are mounted a forward platen 14 and a main cylinder carrier 16 adjacent opposite longitudinal ends of frame 12. Platen 14 and cylinder carrier 16 are secured with respect to one another by a plurality of tie rods 18, four rods for example as shown in FIG. 2. Tie rods 18 extend longitudinally of frame 12 and are secured to platen 14 and cylinder carrier 16 in the well known manner as by threaded nuts 20. Tie rods 18 as installed thus carry all of the ram forces exerted during extrusion operations.

Platen 14 carries an axially-elongated hollow stem 22 which is secured rigidly thereto and projects rearwardly therefrom, or to the right in FIG. 1. Preferably, stem 22 is carried by a multiple position cross slide 24 which permits the stem 22 to be conveniently moved laterally from the extrusion ram axis for stem change or die change operations.

In main cylinder carrier 16, there is disposed a cylinder 26 having a ram 28 which is movable under the impetus of fluid pressure coaxially toward and away from stem 22, as is well known. The forward end of ram 28 is supported in a crosshead 30, which in turn is supported on ways 32 carried by frame 12 for movement of crosshead 30 along frame 12 concomitantly with movement of ram 28.

A pair of fluid-operable piston and cylinder assemblies 34 is carried by main cylinder carrier 16, each having a movable piston rod 35 secured to crosshead 30 to effect movement of crosshead 30 and ram 28 through their advance and return motions.

A container carrier 36 rides on ways 32 longitudinally intermediate crosshead 30 and plate 14 and is movable longitudinally therebetween by double- acting, fluid-operable piston and cylinder assemblies 38 carried by platen 14 and having longitudinally extended piston rods 40 secured to container carrier 36 whereby cylinder assemblies 38 may be selectively actuated to move container carrier 36 longitudinally of frame 12 along ways 32.

Container carrier 36 carries a container 42 which includes a generally-cylindrical through-opening or bore 44 that is maintained in coaxial alignment with stem 22 and with main ram 28. Bore 44 is of a diameter to receive axially therewithin in close sliding relationship a die 46 (FIG. 5), and a forwardly-projecting longitudinal extent of stem 22 whereby die 46 and stem 22 may be passed axially into bore 44. Bore 44 is also adapted to receive adjacent the rearward end thereof a closing plate 62 which is utilized to sealingly close bore 44 during extrusion operations whereby die 46 may be forced through bore 44 by means of press force resulting from ram 28 and piston cylinders 34 from the forward open end to the closed rearward end thereof to extrude a contained metallic billet through the die.

Press 10 further includes a billet carrier 50 which may be laterally movable between a billet receiving position (not shown), and a billet loading position as shown in FIG. 1, whereby a billet may be positioned in coaxial alignment with bore 44 axially intermediate container 42 and closing plate 62.

Inasmuch as features of press 10 as described hereinabove are known in the art, further detailed description of their structure and operation is not believed necessary, and is therefore not included hereinbelow, except insofar as is necessary to describe the structure and operation of the present invention.

Referring further to FIGS. 1 and 2, crosshead 30 carries a crosshead slide 52 which is slidably mounted in laterally-extending ways 54 formed in a forwardly facing end 56 of crosshead 30. A double-acting fluid-operable piston and cylinder assembly 58 is connected between crosshead 30 and crosshead slide 52 for selectively operating positions thereof. In a first operating position, a closing plate portion 60 of crosshead slide 52 is positioned coaxially with ram 28 and container bore 44 for closing the rearward end of container bore 44. Closing plate portion 60 of crosshead slide 52 includes the closing plate 62 and suitable backup bolster means 64. The closing plate 62 is of a diameter to be closely received within bore 44 and is thus able to be moved into interfitting relationship therewith to close the rearward end of bore 44 during extrusion operations.

Crosshead slide 52 is also selectively movable to a second operative position by operation of cylinder assembly 58 to coaxially align a die receiving ring 66 with bore 44 whereby, at the end of an extrusion cycle, the die 46 and butt end may be stripped out of the continer bore 44 and retained in die receiving ring 66 by a clamping means 67 for subsequent shearing of the butt end from the die 46. For this purpose, a butt shear 68 is carried by crosshead 30. More specificaly, crosshead 30 includes an upstanding shear support portion 70 which carries thereon a fluid operable shear having a cylinder portion 72 secured in support portion 70, and a piston rod or ram portion 74 (FIG. 2) having a shear blade 76 affixed adjacent to the free end thereof. As will be seen in FIG. 2, shear 68 is preferably located in a plane containing the axis of ram 28 and the axis of container bore 44, whereby, upon actuation of shear 68, shear blade 76 shears off a billet butt end from a die retained on such common axis.

Figure 3:
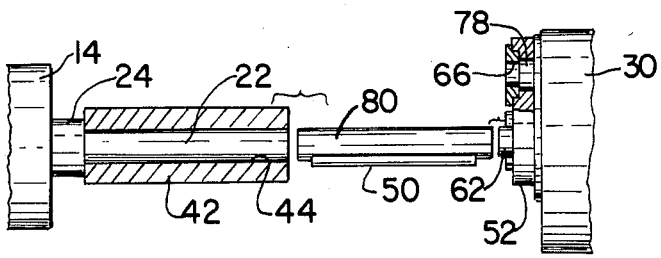

As shown in FIG. 3, die receiving ring 66 is positioned in crosshead slide 52 directly adjacent a vertically-upwardly open passage 78 which is sized to receive shear blade 76. Accordingly, when crosshead slide 52 is in the die receiving position with die receiving ring 66 located coaxially with respect to container bore 44, passage 78 is aligned to allow shear blade 76 to pass thereinto for shearing off a billet butt end.

Figure 10:
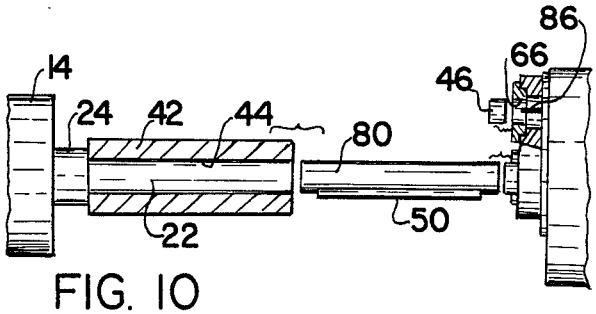

FIGS. 3 and 10, taken in numerical sequence, illustrate an operating cycle of the press 10, and in particular, the operation of shear 68 and its cooperation with other elements of the invention. In FIG. 3, press 10 is depicted by platen 14 and forwardly-projecting stem 22 adjacent one end of the press 10 and crosshead 30 spaced longitudinally therefrom and movable axially with respect thereto. Crosshead slide 52 is in its extrusion position with closing plate 62 coaxially aligned with opening of bore 44 in container 42. Container 42 is in its forwardmost position such that stem 22 extends substantially throughout the length of bore 44. A billet 80 is positioned upon billet carrier 50 in coaxial alignment with bore 44 for insertion thereinto as container 42 is moved axially rearward (FIG. 4) into engagement with closing plate 62, and tightly engaged therewith by fluid pressure acting through cylinder assemblies 38. A die 46 is positioned adjacent the forward end of bore 44, and as ram 28 is actuated to drive crosshead 30 together with container 42 and billet 80 in a forward direction, die 46 is trapped within bore 44 between billet 80 and the forward end of stem 22. Continued high pressure actuation of ram 28 and piston cylinders 34 force billet 80 to be extruded through die 46 and into the hollow interior of stem 22, as at 84 (FIG. 5), thus leaving at the end of the extrusion operation a butt end 82 of billet 80 within bore 44 between die 46 and closing plate 62.

Figure 7:
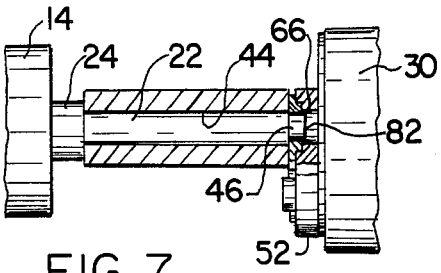
Figure 4:
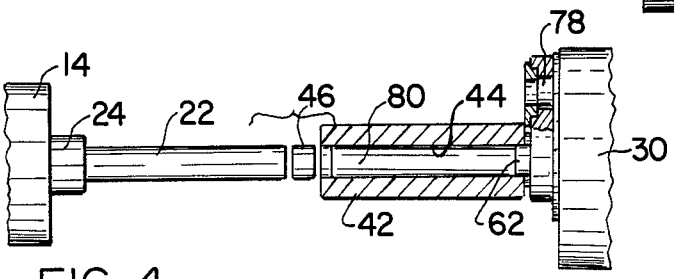
Figure 8:
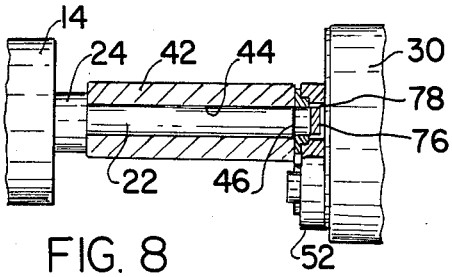
Figure 5:
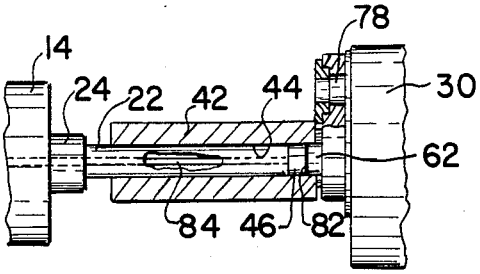
Figure 9:
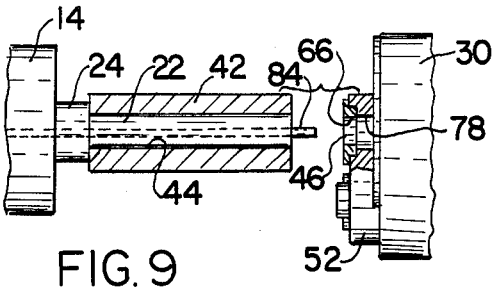
Figure 6:
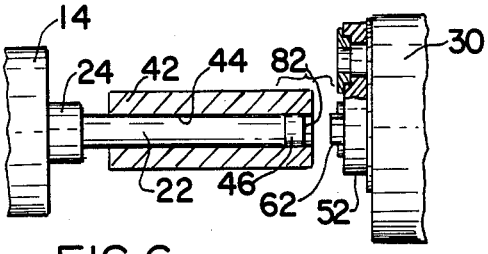

As the operation cycle proceeds (FIG. 6), ram 28 is retracted by actuation of cylinder assemblies 34 thus drawing crosshead 30 back to permit closing plate 62 and crosshead slide 52 to clear the end of container 42. Crosshead slide 52 is then moved by actuation of cylinder assembly 58 to position the die receiving ring 66 in coaxial alignment with bore 44 (FIG. 7). It will be seen from a comparison of FIGS. 5 and 7 that at the end of the extrusion of a billet, container 42 has not yet been moved against the stop at platen cross slide 24. Accordingly, after die receiving ring 66 has been coaxially aligned with opening 44, ram 28 is again actuated to engage die receiving ring 66 with the end of bore 44 and to move container 42 against the stop at cross slide 24, thereby stripping butt end 82 and die 46 out of bore 44 and into the die receiving ring 66. The longitudinal dimensions of die 46, stem 22, container 42 and die receiving ring 66 are coordinated such that when these elements are positioned as shown in FIG. 7, the interface of butt end 82 with die 46 is located on the shear plane of shear blade 76 whereby upon actuation of shear 68, blade 76 passes into passage 78 to shear butt end 82 from die 46 (FIG. 8).

After shearing, the extrusion 84 is gripped by any suitable means while cylinders 34 are actuated to retract crosshead 30, and thus die 46, which is clamped by clamp 67 securely in ring 66 is pulled from the end of the extrusion 84. The completion of the extrusion cycle is shown in FIG. 10 as crosshead 30 is retracted to permit movement of another billet 80 into position, the butt shear has returned to its initial upward position and crosshead slide 52 has been moved back to its first-described position where closing plate 62 is coaxially aligned with bore 44. In addition, a suitable ejection means 86 is actuated to eject die 46 from the die receiving ring 66 to be transferred to an inspection and cleaning position before subsequent loading between stem 22 and container 42, FIG. 4. In addition, after butt shearing, with the shear in the down position, a suitable clamp device 79 (FIG. 2) clamps butt 82 to prevent sticking butts from being lifted back up while the shear returns to hinder butt sticking action on shear blade 76 and on face of die 46. The butt clamp releases after crosshead 30 has fully returned, locating butts above a simple discard transfer system.

According to the description hereinabove, there is provided by the present invention an improved indirect extrusion apparatus wherein a butt shear is mounted on the main ram crosshead to operate in cooperation with a crosshead slide which provides a closing plate in one operating position thereof and a die receiving means in another operating position thereof, whereby the butt end of an extruded billet may be sheared from the extrusion die without having to first withdraw the die and attached butt end through the whole length of the container and without having to impose large magnitude shearing stress on the container or container holder, or to introduce an additional die supporting device for the purpose of transferring the shear loads to the container holder frame. The attached closing plate 62 of crosshead slide 52 eliminates the use of a commonly known loose dummy block thus also eliminating the need for an elaborate dummy block handling system, often subject to a high degree of service and maintenance. Accordingly, the installation will be less complicated, having better operating efficiency.

Inasmuch as a presently-preferred embodiment of the invention has been described hereinabove, it will be appreciated that the invention may be practiced in various alternative embodiments with numerous modifications thereto without departing from the broad spirit and scope thereof. For example, the invention may be utilized in conjunction with either loose die or fixed die arrangements, for a combination direct/indirect press with piercing or non-piercing machines, and in other variations and combinations. In addition, it will be appreciated that the axis of the stem 22 and bore 44, as well as the operative axis of die receiving ring 66, need not necessarily coincide with the axis of ram 28. Furthermore, the butt shear, the crosshead slide and its actuation means, and the specific structural features of the die receiver and clamp, the die ejector, and other components may be varied within a wide design latitude so long as the requisite structural and operational features are retained. These and other embodiments and modifications having been envisioned and ancitipated by the inventor, it is intended that the invention be construed as broadly as permitted by the scope of the claims appended hereto.

I claim:

1. In an extrusion press including a platen and a movable crosshead which supports the free end of a main ram for movement thereof toward and away from the platen and additionally including extrusion container means for supporting a billet intermediate the platen and the crosshead for extrusion of the billet through an extrusion die under the impetus of extrusion force applied by the main ram to the billet, the improvement comprising:

a butt shearing means carried by said crosshead;

said shearing means including a butt shear and a cooperable die support means carried by said crosshead and operable to shear the butt end of such a billet from such a die subsequent to extrusion of such billet in a manner that all reaction forces of the butt shearing are carried by said crosshead.

2. The improvement as claimed in claim 1, wherein the extrusion press is an indirect extrusion press.

3. The improvement as claimed in claim 1, wherein said butt shear is a fluid-operable butt shear.

4. In an extrusion press, including a platen and a movable crosshead which supports the free end of a main ram for movement thereof toward and away from the platen and additionally including billet container means for supporting a billet intermediate the platen and the crosshead on an axis for extruding such a billet through an extrusion die along said axis under the impetus of extrusion force provided by said main ram to such a billet, wherein subsequent to such extruding, an unextruded butt end of such billet may remain adjacent such die, the combination comprising:

a butt shear carried by said crosshead;

and a selectively positionable die receiving means carried by said crosshead for receiving such a die and an attached butt end and for supporting such die and attached butt end for shearing of such butt end from such die by said butt shear in a manner that all reaction forces of such shearing are carried by said crosshead.

5. The combination as claimed in claim 4, wherein said positionable die receiving means is a die receiving portion of a cross slide carried by said crosshead for movement laterally of said axis.

6. The combination as claimed in claim 5, wherein said cross slide is movable laterally of said axis to at least a pair of operative positions wherein in one of said operative positions, said die receiving means is coaxially aligned with said axis.

7. The combination as claimed in claim 6, wherein said cross slide includes a closing plate portion which is coaxially aligned with said axis when said cross slide is positioned in the other of said operative positions whereby said closing plate portion is cooperable with said billet container means to apply such extrusion force of said main ram to extrude such billet through such die.

8. The combination as claimed in claim 7, wherein said butt shear is located such that when actuated, a shear blade portion thereof intercepts said axis.

9. The combination as claimed in claim 8, wherein, when said cross slide is in said one operating position, said die receiving means is able to receive such a die and attached butt end with the interface between such die and attached butt end positioned on the shear plane of said shear blade portion.

10. The combination as claimed in claim 9 additionally including clamp means associated with said die receiving means for securing such die and attached butt end in said die receiving means.

11. The combination as claimed in claim 10 wherein said axis is coaxial with the axis of said main ram.

12. The combination as claimed in claim 11 additionally including ejector means cooperable with said die receiving means for ejecting such a die from said die receiving means.

13. The combination as claimed in claim 12, wherein said extrusion press is an indirect extrusion press wherein an elongated hollow stem is carried by the platen and extends on said axis to project into and through said billet container means.

14. The combination as claimed in claim 13, wherein said die receiving means is cooperable with said ram, said billet container means and said stem to move such die and attached butt end into engagement with said die receiving means and to position the interface between such die and such attached butt end on the shear plane of said blade portion.

15. The combination as claimed in claim 14, wherein said shear is a fluid-operable shear.

16. The combination as claimed in claim 15, additionally including fluid-operable means for moving said cross slide between said pair of operative positions.

17. The combination as claimed in claim 4, including butt end clampling means carried by said crosshead and positioned to clamp such a butt end after it has been sheared from said die by said butt shear.

18. In an indirect extrusion operation, wherein a billet container having an axially elongated bore carries a billet in said bore and a movable crosshead axially adjacent one end of said container supports the free end of a main ram for extrusion of such a billet through a die which is passed axially into said bore via the end thereof opposite said one end, and wherein after the extrusion operation a residual billet portion remains within said bore and includes an unextruded butt end of the billet attached to one side of the extrusion die and a length of the extruded form extending through the die and projecting out of the other side thereof, the method of removing such a residual billet portion from the extrusion die comprising the steps of:

stripping said die and the attached butt end out of said one end of said bore;

positioning said die and the attached butt end adjacent said crosshead on said axis of extrusion;

moving said die axially to align the interface between said die and said butt end on a predetermined shear plane adjacent said crosshead and to rigidly support said die with respect to said crosshead;

shearing said butt end from said one side of said die against reaction surfaces which are supported by said crosshead;

and pulling said projecting length of the extruded form through said other side of said die.

19. The method as claimed in claim 18, including the additional step of moving said die laterally from said axis of extrusion subsequent to said pulling step.

20. The method as claimed in claim 18, including the additional step of clamping said butt end after said shearing step.

* * * * *